United States Patent [19]

Rogers

[11] 4,031,907

[45] June 28, 1977

[54] HAIR CURLING APPARATUS

[76] Inventor: William B. Rogers, Rte. No. 1, East Jordan, Mich. 49727

[22] Filed: July 6, 1976

[21] Appl. No.: 702,696

[52] U.S. Cl. ..... 132/40
[51] Int. Cl.[2] ..... A45D 2/00
[58] Field of Search ..... 132/40, 41, 42 R, 44, 132/39

[56] References Cited

UNITED STATES PATENTS

| | | | |
|---|---|---|---|
| 2,613,679 | 10/1952 | Vaughn | 132/41 R |
| 2,708,941 | 5/1955 | Field, Sr. | 132/44 |
| 2,772,681 | 12/1956 | Swenson et al. | 132/40 |
| 3,905,380 | 9/1975 | Bontempi | 132/40 |

FOREIGN PATENTS OR APPLICATIONS

| | | | |
|---|---|---|---|
| 557,650 | 6/1957 | Belgium | 132/40 |

*Primary Examiner*—G.E. McNeill
*Attorney, Agent, or Firm*—Harness, Dickey & Pierce

[57] ABSTRACT

A hair curling apparatus has a generally tubular cylindrical roller-like body with a plurality of axially extending rows, angularly spaced from each other, of relatively short generally radially extending spaced projections effective for generally frictionally engaging strands of hair as such hair is generally rolled onto and about the body; a comb member is supportingly journalled from and by one axial end of the roller-like body with such comb member being first employable for combing the strands of hair to be rollingly wound onto the roller body and being secondly employable to generally lockingly engage both such wound strands of hair and the roller body as to thereby secure the roller body in position and prevent the roller body from becoming unintentionally released from the strands of hair wound thereon.

1 Claim, 20 Drawing Figures

HAIR CURLING APPARATUS

BACKGROUND OF THE INVENTION

Heretofore the prior art has suggested various hair curler devices. Generally, at least an overwhelming majority of such prior art devices are of a tubular cylindrical configuration defining a hair roller. A first type of such a prior art roller has in the most part a relatively thin solid tubular wall with a limited number of perforations or apertures formed therethrough apparently for accommodating a limited amount of air circulation therethrough. Such first type of hair roller also has a plurality of nub-like projections integrally formed on the radially outer surface of the overall roller.

A second type of prior art roller comprises a generally tubular cylindrical configuration with the overwhelming major portion of what could be generally considered the wall containing radially directed through apertures. Such apertures are defined and determined as by a plurality of radially angularly spaced longitudinally extending struts or ribs which intersect and connect with a plurality of annular or circumferential axially spaced rings. A plurality of axially spaced radially outwardly extending short teeth-like protuberances are integrally formed on and carried by each of such struts.

A third type of prior art hair curler is comprised of a helically coiled or wound main body within which is situated a cylindrical brush-like member having a helically wound center core wire which holds and directs bristles radially outwardly therefrom as to extend radially outwardly beyond the radial extremity of the wire main body. A tubular wide mesh stocking-like member is situated as an overlay enveloping the wire main body with such stocking member being of fine wire or plastic material and the loose mesh thereof permitting the extension therethrough of the brush bristles.

Usually, a person employing such prior art hair curlers employs the following steps. First, a comb is picked-up and a selected portion of hair is combed into a generally straight lock or tress with such being possibly in the order of 2 inches wide. Next, while one hand holds the combed tress of hair, the comb, previously used to define such tress, must be layed down after which with such free hand, a prior art roller is grasped and placed in contact with said tress near or at the free ends of the hair strands comprising the tress. The prior art roller is then rollingly rotated against the tress of hair, while the tress is being wound thereupon, until the roller attains a desired position relative to the scalp. After that is achieved, the person must still secure the roller against undesirable disengagement with the rolled trees of hair thereon. In those prior art roller structures wherein the tubular body is mostly a solid tubular wall or one where very small or only a few apertures are formed therethrough, it has been necessary to employ generally U-shaped hair pins where the opposed legs thereof are normally resiliently closed in longitudinal abuting relationship with each other. This, in turn, requires the person to continue holding the wound roller with one hand while, with the other hand, attempting to spread open the opposed legs of the U-shaped hair pin and while continuing to hold open such legs, which are resiliently trying to return to the normal closed position, attempt to generally cooperatively engage such U-shaped hair pin with the wound roller by, generally, inserting such U-shaped hair pin into the roller from one open end thereof. More specifically, such U-shaped hair pin must be placed as to have one leg thereof engaging the radially inner surface of the tubular wall of the roller while the other leg must be placed as to be radially outwardly of and against the strands of hair defining the tress wound about such roller.

In situtations where prior art rollers having many relatively large openings formed through the main body of the roller are employed, the steps in using such are the same as herein previously described. Except that the presence of many large openings enables the use of various forms of prior art straight pins (often made of plastic) whih may be in the order of approximately 2¼ inches shank length. Such straight pins may be employed for securing the wound roller against unintentional release of and from the tress of hair. However, this still requires that the person first look for and pick-up such straight pin and then insert it, in a generally skewed or inclined relationship through the wound tress of hair and into the roller. Usually, in order to be relatively assured that such unintentional release will not occur, two or more of such straight pins are employed for each wound roller.

Still another type of prior art hair curler roller is employed. Such may be more accurately described as an assembly in that the main roller body, which may be of tubular cylindrical configuration with a great number of radially extending apertures formed through the tubular wall, coacts with a locking member which, axially, is generally coextensive with the main roller body and which, when viewed in an axially end view is of a C-shaped configuration. With such a prior art roller assembly, often the tress of hair is wound on and about the main roller body the C-shaped locking member must forcibly be placed onto and over the wound hair and roller body as to contain the wound hair on such roller body. One of the problems of this arrangement is that the C-shaped configuration must be forcibly spread open in order to get it to fit over the effective diameter of the roller body and the hair wound thereabout. Another problem of this arrangement is that, the main roller body is often provided with a plurality of relatively short radially outwardly extending spaced tooth-like projections carried on the radially outer surface of the tubular roller body. Such projections not only frictionally engage the tress but also result in an interfering abutment with the C-shaped lock member when such is attempted to be placed into cooperative locking engagement with the roller body.

In addition to the intrinsic problems generally associated with the above prior art structures and the method of employing such, other safety problems also exist.

For example, it is quite possible to injure ones scalp especially where the straight pin type of locking means is employed. Also, in situations where children are present, as often occurs when the mother of such children is curling her hair at home, the children can, and have been known to, take such straight pins and/or U-shaped hair pins, without the mother's knowledge, and accidentally inflict various injuries upon themselves.

Accordingly, the invention as herein disclosed and claimed is primarily directed to the solution of the preceding and related and attendant problems.

SUMMARY OF THE INVENTION

According to the invention, a hair curling apparatus comprises a roller body, aperture means formed through such roller body, and comb means pivotally carried by said roller body, said comb means being effective when in one of its operative conditions to comb selected strands of hair into a selected tress, said roller being effective to be rotatably wound along and on said tress as to thereby form at least one complete coil of said tress about said roller, and said comb means when in a second of its operating conditions being effective to lock said tress against said roller as to thereby prevent unintentional release of said roller from said tress.

Various objects and advantages of the invention will become apparent when reference is made to the following detailed description considered in conjuction with the accompanying drawings.

BRIEF DESCRIPTION OF THE DRAWINGS

In the drawings, wherein for purposes of clarity certain elements and/or details may be omitted from one or more views.

DETAILED DESCRIPTION OF THE PREFERRED EMBODIMENTS

Figure 1:
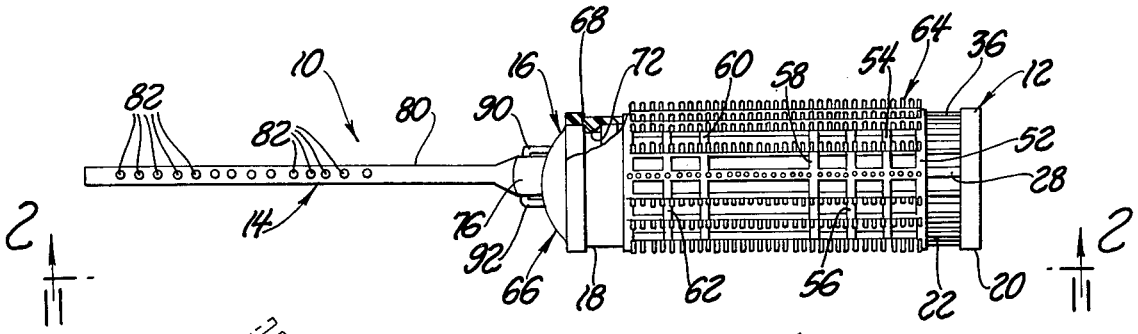
FIG. 1 is generally a top plan view of a hair curling apparatus employing teachings of the invention.
Figure 2:
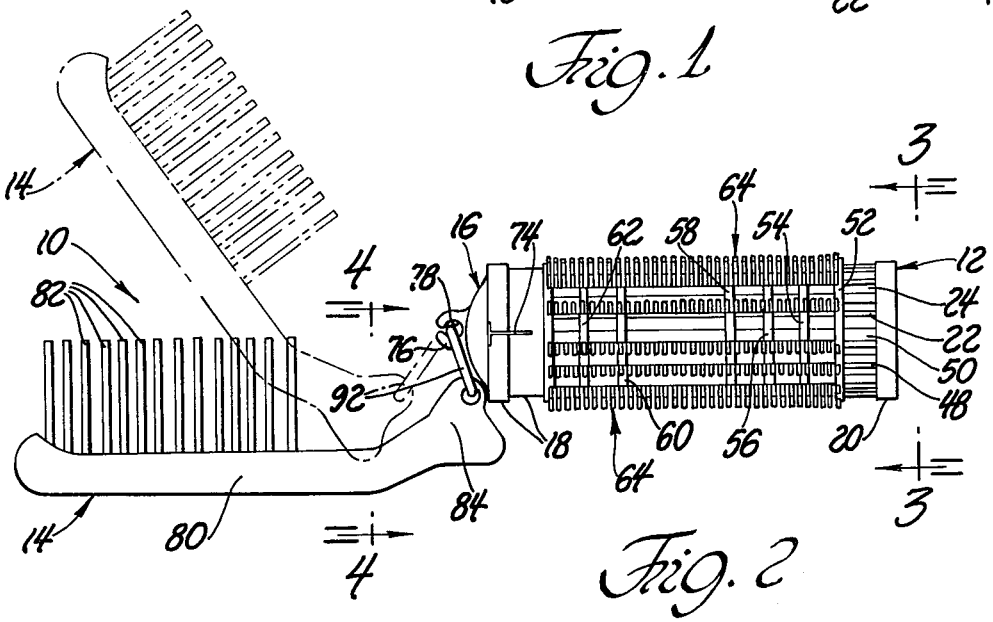
FIG. 2 is a side elevational view of the apparatus of FIG. 1 taken generally on the plane of line 2—2 of FIG. 1 and looking in the direction of the arrows.
Figure 3:
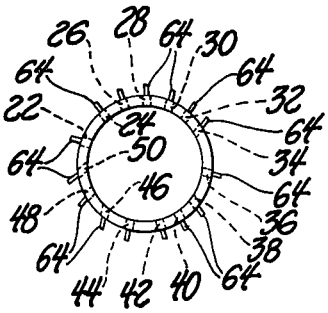
FIG. 3 is an end elevational view of a portion of the apparatus of FIGS. 1 and 2 taken generally on the plane of line 3—3 of FIG. 2 and looking in the direction of the arrows.

Referring now in greater detail to the drawings, FIGS. 1 and 2 illustrate a hair curling apparatus 10, embodying teachings of the inventions, as comprising a roller member 12, a comb member 14 and means 16 operatively interconnecting the comb member 14 to the roller 12. As generally depicted by FIGS. 1, 2 and 3, the roller 12 may comprise a generally tubular cylindrical configuration formed as by annular first and second end portions 18 and 20 between which radially angularly spaced longitudinal generally axially directed struts 22, 24, 26, 28, 30, 32, 34, 36, 38, 40, 42, 44, 46, 48 and 50 are provided and preferably integrally formed at respective opposite ends to such portions 18 and 20. Such struts are, in turn, preferably interconnected as by annular ring-like portions 52, 54, 56, 58, 60 and 62 generally axially spaced along the roller 12. Further, preferably, each such strut carries an axially extending row of relatively short projections 64 spaced from each other and preferably integrally formed with respective associated struts.

Figure 5:
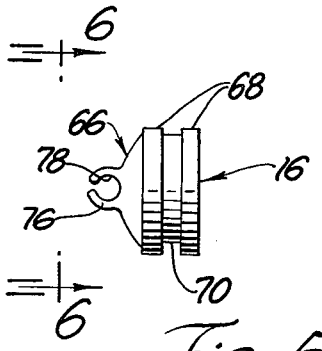
FIG 5 is an elevational view of the comb supporting portion of the roller.
Figure 6:
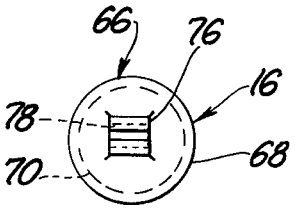
FIG. 6 is a view taken in the direction of the arrow 6—6 FIG. 5.

As also shown in FIGS. 5 and 6, the connecting means 16 comprises a bearing-like member 66 which has a generally cylindrical body 68 with an annular groove 70 formed into the periphery thereof. The body 68 is relatively loosely received as within end 18 of roller 12 as to be freely rotatable therein. As shown in FIG. 1, the inner cylindrical surface of the roller 12 is provided with a radially inwardly directed annular retainer ring 72 which may, for example be integrally formed with end portion 18. The retainer ring precludes unintentional axial disengagement as between roller 12 and bearing 66. If the roller 12 is molded of somewhat resiliently deformable material, such as plastic, a slit 74 may be cut into end portion 18 as to allow for the resilient deformation thereabout permitting the insertion of the bearing 66 into such end portion and the subsequent reception of retainer ring portion 72 within groove 70.

Further, bearing member 66 is preferably provided with an integrally formed pivot portion 76 which in end view is of a generally C-shaped configuration defining a bearing surface 78.

Figure 4:
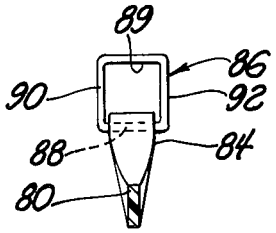
FIG. 4 is a cross-sectional view taken generally on the plane of line 4—4 of FIG. 2 and looking in the direction of the arrows.

Referring in particular to FIGS. 1, 2 and 4, the comb member 14 is illustrated as comprising as comb back or main body 80 carrying a plurality of spaced teeth 82. One end 84 of comb body 80 is provided with a hinge member 86 which, in the embodiment under consideration, comprises a rectangular-like wire member which, at its portion 88, is fixedly secured to end 84 of comb body 80 as to thereby maintain a fixed relationship relative thereto. With such a relationship being maintained, the comb member 14 may automatically assume a generally parallel relationship to roller 12 when it is opened to its fully opened condition depicted in FIG. 2. The hinge member 86 may be thusly fixedly secured as by, for example, molding the hinge member with and into end 84 of comb body 80. As clearly shown, pivot portion 89 of hinge 86 is pivotally received with pivot or journal surface 78 of bearing 66 while the generally laterally spaced arms or joining portions 90 and 92 are disposed generally on opposite sides of pivot portion 76 (FIG. 1).

OPERATION OF INVENTION

Figure 7:
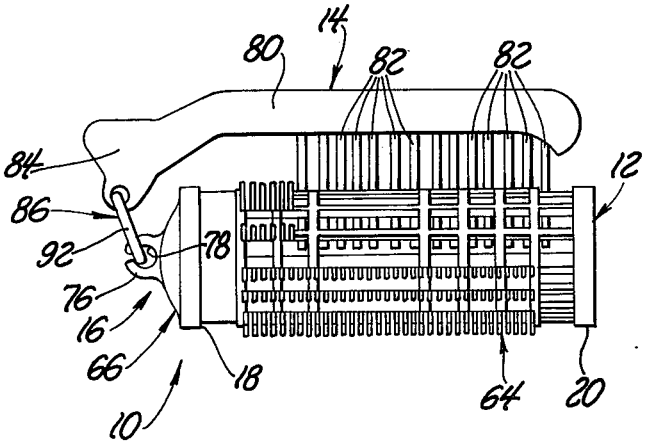
FIG. 7 is a view similar to that of FIG. 2 and illustrating a particular condition of operation different from that of FIG. 2.

Generally, the operation and use of the invention is as follows. With comb member 14 opened, generally as depicted in FIG. 2, the comb and teeth 82 may be employed for combing selected strands of hair into a selected tress. Without having to lay the comb down onto anything, the roller 12, to which comb portion 14 is swingably secured. is placed against the tress of hair, near the ends of the strands thereof, and rolled thereagainst causing the tress to become wound thereabout as the roller 12 rollingly approaches the scalp. When the roller 12 has been thusly rolled a desired amount, the comb member 80 is swung generally upwardly and clockwise (through an intermediate position depicted in phantom line in FIG. 2) until finally the comb attains a position as generally depicted in FIG. 7 whereat the teeth 82 pass as between strands of hair of the rolled tress carried by the roller and also pass through the apertures within roller 12 as defined generally by and between adjacent struts 22 –50 and annular rings 52–62. When the comb member 14 thusly attains the position depicted in FIG. 7, the wound or coiled tress is virtually trapped both axially and radially by the coaction of comb body 80, comb teeth 82 and roller 12 thereby completing that particular hair curling operation and precluding unintentional disengagement of the coiled tress from the roller 12.

Figure 8:
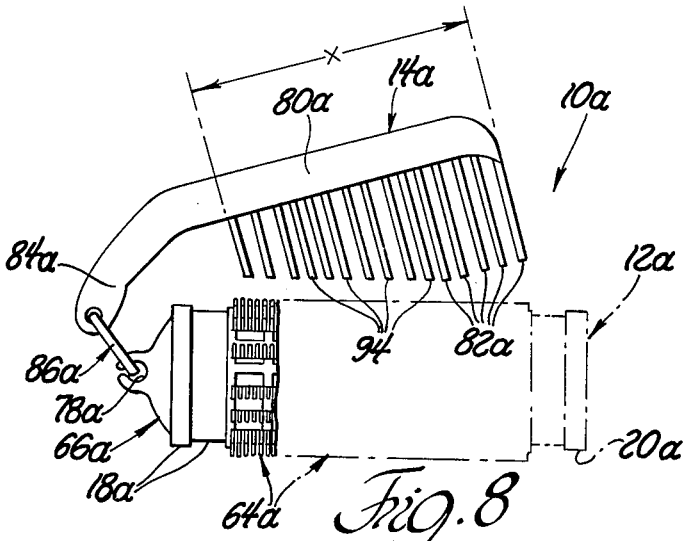
FIG. 8 is a view similar to that of FIG. 7 and illustrating a modification of the invention.

FIG. 8 illustrates a first modification of the invention. All elements in FIG. 8 like or similar to those of preceding FIGS. are identified numerals provided with a suffix *a*. With specific reference to FIG. 8, it can be seen that at least some of the teeth 94 of comb 14*a* have been formed as to be progressively shorter as the location of each of such teeth more nearly approaches end 84*a* of the comb member 14*a*. Depending on the location and size of the apertures within the roller 12*a*, the contouring of teeth 94 enables the effective width or length, X, of the comb teeth to be at a maximum and still avoid an interfering bindng between the end of the teeth, closer to the pivot point, and the surfaces of roller 12*a* defining such apertures as the comb member 12*a* is being swung into the condition and/or position shown in FIG. 7.

Figure 9:
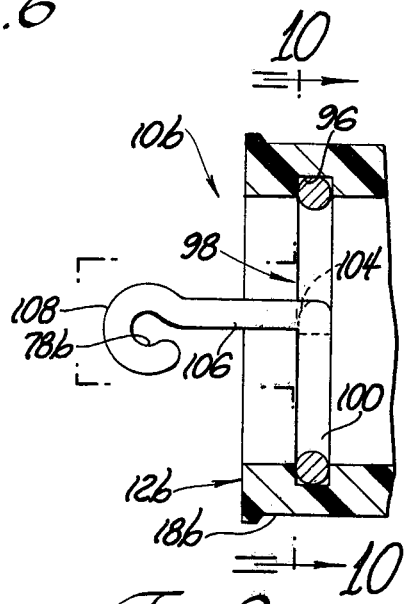
FIG. 9 is an enlarged fragmentary cross-sectional view of a portion of a further modification of the invention.
Figure 10:
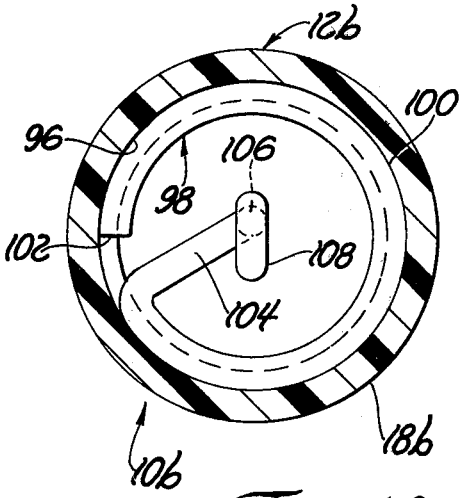
FIG. 10 is a cross-sectional view taken generally on the plane of line 10—10 of FIG. 9 and looking in the direction of the arrows.

FIGS. 9 and 10 illustrate another modification of the invention. All elements shown in FIGS. 9 and 10 and similar to those of the preceding Figures are identified with like reference numerals provided with a suffix *b*. Those elements not specifically shown in FIGS. 9 and 10 for purposes of disclosure, may be assumed to be as that shown in any of the preceding FIGS.

In the embodiment of FIGS. 9 and 10, an inner annular groove or recess 96 is formed within the curler body 12*b*, as at end 18*b*, and rotatably receives a bearing member 98. The bearing member 98 may be comprised of a wire-like material formed as to have a generally annular or ring-like main body 100 which has a first end 102 situated in said groove 96 as to be rotatably movable relative thereto. The ring body 100 has a generally radially inwardly directed portion 104 which, in turn, is formed as to have a generally axially directed extension 106 with a hook-like journal portion 108 formed at the end thereof defining a journal surface 78*b* for coaction as with hinge means 86*a* (FIG. 4). As is best seen in FIG. 10, end 102 is displaced some distance from where radial directed portion 104 joins main body 100. This enables the body 100 to be generally radially inwardly resiliently compressed as to thereby permit the introduction of the main body 100 into the interior of roller 12*b* and subsequently resiliently expand as to then become axially contained between opposed axial walk of groove 96. As previously stated, bearing member 98 is generally freely rotatable within the confines of groove 96 while, obviously, comb member 14 is swingably or pivotably supported by the journal portion 108.

Figure 11:
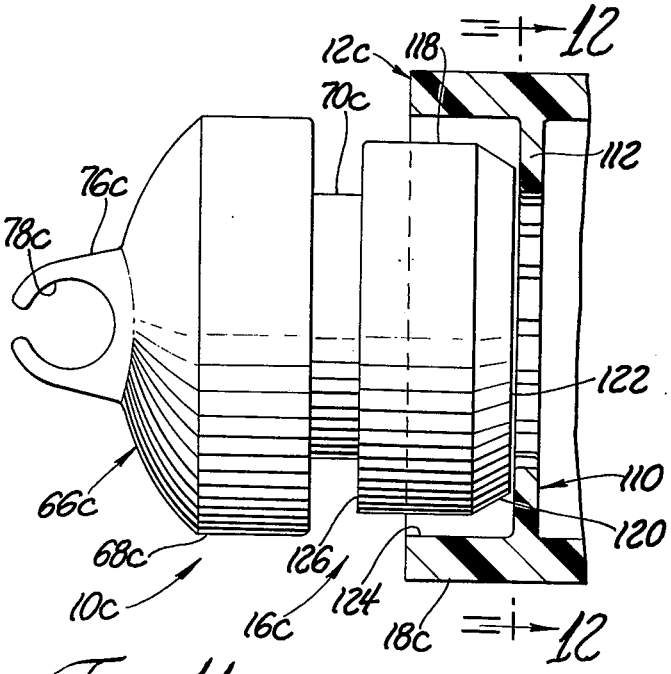
FIG. 11 is an enlarged fragmentary view of a portion of still another modification of the invention.
Figure 12:
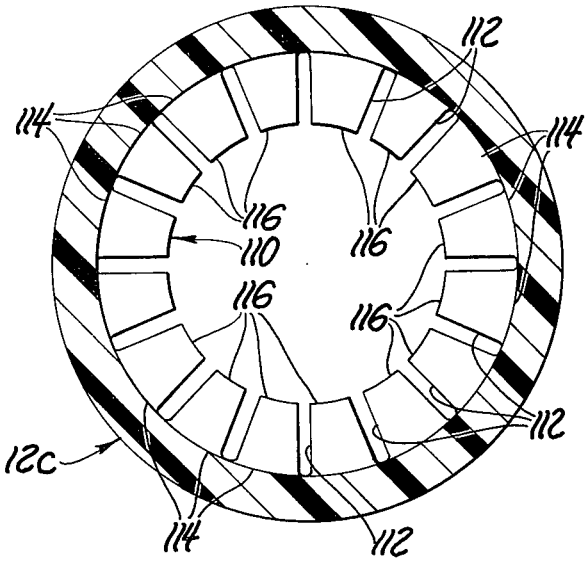
FIG. 12 is a cross-sectional view taken generally on the plane of line 12—12 of FIG. 11 and looking in the direction of the arrows.

FIGS 11 and 12 illustrate still other means for swingably interconnecting the roller 12*c* to the cooperating comb as, for example, at 14 of FIG. 1. Such swingable interconnecting means 16*c* is illustrated as comprising a generally internally disposed ring 110 formed integrally with, for example, end 18*c* of roller 12*c* as to be radially inwardly directed. As best seen in FIG. 12, the over-all ring-like configuration 110 is, in turn, comprised of a plurality of annular segments 112 having their respective radially outer ends 114 integrally joined to roller 12*c* and their respective inner ends 116 free. Especially in the case where the roller 12*c* and ring configuration 110 are molded of resiliently deflectable material, each of the segments 112 are resiliently deflectable axially of the roller 12*c*.

The means 16*c* is further illustrated as comprising a bearing member 66*c* which, as compared to for example bearing member 66 of FIGS. 5 and 6, differs as by having a relatively large outer cylindrical surface 68*c* and a comparatively smaller diameter cylindrical surface 118 which is intersected as by a conical surface 120 formed at the right-most end 122 thereof. As bearing member 66;*c* is axially moved into roller 12*c* end 122 engages segments 112 of ring structure 110 and the conical surface 120 serves to resiliently radially outwardly deflect such segments 112 as to respectively assume positions generally between the interior of roller 12*c* and outer surface 118. The segments 112 will continue to remain in such positions until bearing member 66*c* has been sufficiently axially inwardly displaced permitting each of the thusly deflected segments 112 to resiliently return to their respective normal positions within groove 70*c*. When such segments 112 are thusly received within groove 70*c* surface 68*c* is in free but nevertheless close proximity to inner surface 124 or roller 12*c* and bearing member 66*c* becomes effectively axially contained within roller 12*c*. It should be apparent that, comparatively, withdrawal of bearing member 66*c* is made much more difficult than the original insertion thereof because of the comparatively greater effective outer diameter of the axial groove wall 126 which, of course, would result in such surface abutting against the segments 112 at a location much closer to effective ends 114 thereof and, because of the resulting reduction in effective lever arm, consequently require a much greater force to deflect segments 112 to achieve withdrawal of the bearing member 66*c*.

Figure 13:
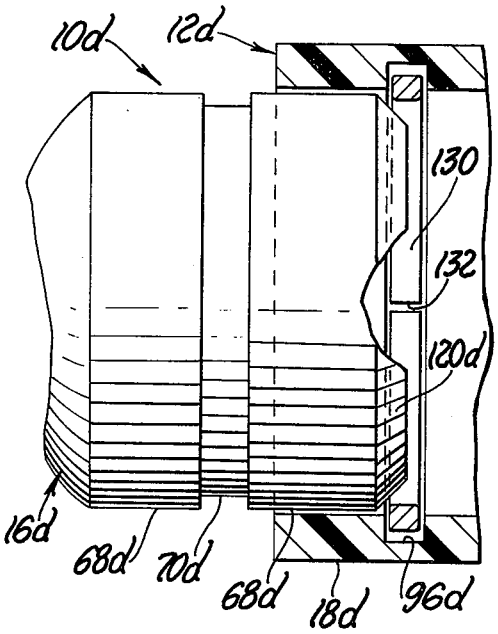
FIG. 13 is an enlarged fragmentary partly cross-sectional view of a portion of a further modification of the invention.

FIG. 13 illustrates, fragmentarily, another modification of the invention. Elements which are like or similar to any of the preceding FIGS. are identified with like reference numerals provided with a suffix *d*. An annular spring-like retainer ring 130, cut at one location as at 132, is loosely received within annular groove 96*d*. As bearing member 16*d* is moved axially inwardly of roller 12*d*, the camming surface 120*d* engages and radially outwardly resiliently expands retainer ring 130 as to thereby accommodate the passage of the rightmost portion of surface 68*d*. When groove 70*d* attains a radially juxtaposed relationship to thusly resiliently expanded retainer ring 130, ring 130 in effect resiliently returns to its illustrated normal configuration thereby becoming contained by both radially outer groove 96*d* and radially inner groove 70*d* and consequently permitting relative rotation between bearing 16*d* and curler 12*d* while effectively precluding undesirable relative axial motion therebetween.

Figure 14:
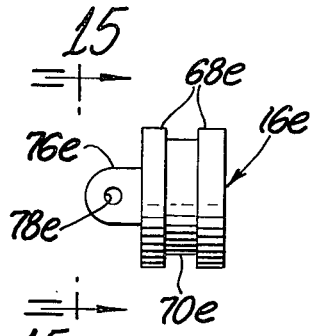
FIG. 14 is a side elevational view of an element similar to that of FIG. 5 but a modification thereof.
Figure 15:
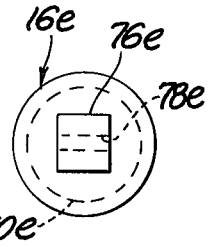
FIG. 15 is a view taken generally on the plane of line 15—15 of FIG. 14 and looking in the direction of the arrows.

In FIGS. 14, 15 and 16, 17, which illustrate further modifications, those elements which are like or similar to, for example, FIGS. 5 and 6 are identified with like reference numerals and respectively provided with suffixes *e* and *f*. In FIGS. 14 and 15, the journal portion 76*e* is like that at 76 of FIG. 5 except that it defines a peripherally closed journal surface 78*e* instead of the correspondng C-shaped configuration.

Figure 16:
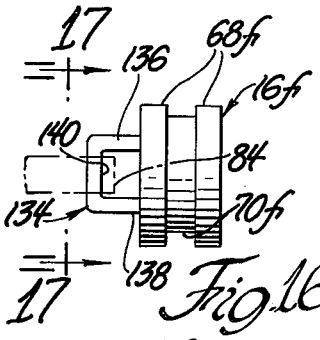
FIG. 16 is a side elevational view of an element similar to that of FIG. 14 but a modification thereof.
Figure 17:
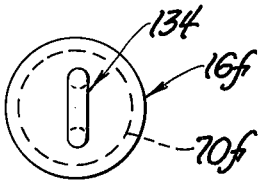
FIG. 17 is a view taken generally on the plane of line 17—17 of FIG. 16 and looking in the direction of the arrows.

In FIGS. 16 and 17 a generally U-shaped member 134 is carried by the main body portion of bearing member 16*f* as to have opposed leg portions 136 and 138 joined as by a bight portion 140 which serves as a pivot for securing the end 84 (FIG.2) of the cooperating comb. As should be apparent, the cooperating comb may be pivotally secured to bearing 16*e* as by, for example, having portion 89 of member 86 cut as to provide two inwardly directed pintle portions, instead of a continuous solid portion 89, and then having such oppositely directed pintle portions received within the open ends of journal surface 78*e*. With respect to the embodiment of FIGS. 16 and 17, the pivotally supported end of the comb member may have a C-shaped configuration similar to that at 76 of FIGS. 2 and 5 in order to thereby operatively pivotally engage pivot portion 140.

Figure 18:
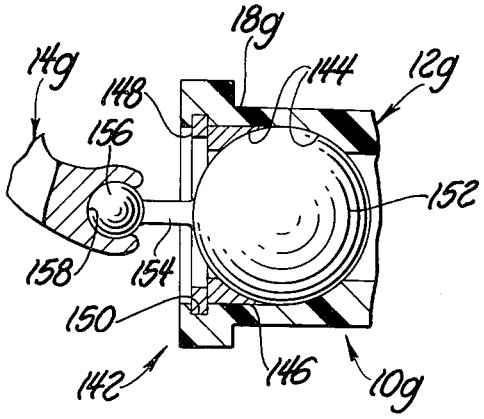
FIG. 18 is an enlarged fragmentary cross-sectional view of a portion of another modification of the invention.

FIG. 18 illustrates a further swingable means 142 for operatively interconnecting the comb member 14*g* to the curler 12*g*. In the embodiment of FIG. 18 the means 142 is illustrated as comprising an internal spherical seat surface 144, defined as by a portion thereof formed in roller 12*g* and a cooperating insert 146 retained as by an internal snap-ring type retainer 148 within a cooperating groove 150. A spherical or ball type bearing 152, rotatably contained within seat 144, carries, as by means of an extension 154, a ball type journal 156 which, as generally depicted, generally universally pivotally engages a cooperating spherical socket portion 158 formed at the pivotal end of comb 14*g*.

Figure 19:
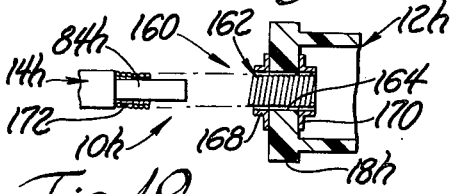
FIG. 19 is a fragmentary cross-sectional view of a portion of still another modification of the invention.

FIG 19 illustrates another means 160 for swingably interconnecting the comb and roller. All elements like or similar to those of any of the preceding Figures are identified with like reference numerals provided with a suffix *h*. In the embodiment of FIG. 19 the swingable connecting means 160 is illustrated as comprising a coiled spring 162 having one end thereof freely passing through an aperture 164 formed as in an end wall 166 of roller 12*h* and axially retained as by thrust plates 168 and 170 suitably secured to coiled spring 162. The other end 172 of spring 162 may be suitably secured to end 84*h* of comb 14*h* by any suitable means as, for example, having such molded, cemented or mechanically fastened to each other. In such embodiment, when in its free state, spring 162 would assume the position illustrated and comb 14*h* would assume a correspondng position whereat the teeth thereof would extend generally normal to the axis of roller 12*h* and the back of such comb 14*h* would extend generally parallel to the axis of roller 12*h*.

Figure 20:
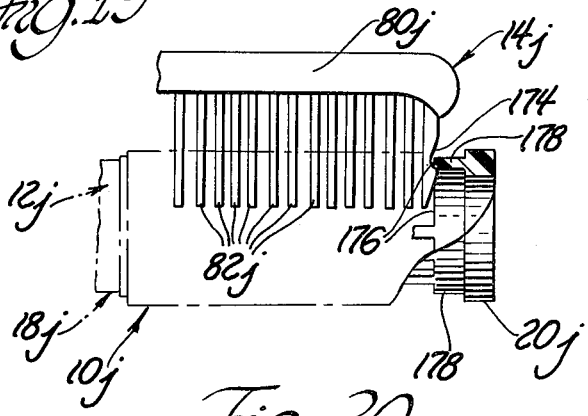
FIG. 20 is a fragmentary partly cross-sectional view similar to that of FIG. 7 and illustrating a further modification of the invention.

FIG. 20 illustrates a further modification which discloses, in its broad concept, the provision of detent means for releasably locking the comb closed against the cooperating roller. Specifically, FIG. 20, wherein elements like or similar to any of the preceding Figures are identified with like reference numerals provided with a suffix *j*, illustrates one form of such detent means as comprising a notch-like recess 174 formed as in the end tooth of teeth 82*j* which is adapted to receive therein end surface 176 of a wall portion 178 of roller 12*j*. As generally indicated, such wall portion 178 is preferably cicumferential and cooperates as with struts 22–50 to define, at that end of roller 12*j*, apertures for accommodating the teeth of comb 14*j*. Other ways of providing suitable detent means at other areas, such as cooperatively provided by and between end 84 and bearing 66, are deemed to be apparent in view of the teachings herein.

It should be pointed out that the invention as herein disclosed is by way of example and not by way of limitation. Accordingly, even though only a preferred embodiment and a number of modifications of the invention have been disclosed and described other embodiments and modifications of the invention are possible within the scope of the appended claims.

I claim:

1. Hair curling apparatus, comprising generally cylindrical roller means having a plurality of apertures formed therein, and comb means usable to comb a tress of hair and pivotally connected to said roller means for rotation about an axis extending generally normal to the central axis thereof, said comb means comprising an elongated body portion having a plurality of teeth extending at substantially a right angle to said body portion, said comb means having at least two operating positions relative to said roller means, the body portion of said comb means extending away from said roller means in one of said operating positions thereby conditioning said comb means for use in combing selected strands of hair into a tress, said roller means being conditioned to accept and roll said tress of hair thereabout into at least one coil of hair while said comb means is in said one operatng position, said comb means being rotatable about its axis of rotation relative to said roller means to a second operating position, the teeth on said comb means penetrating the trees of hair on said roller means and being received in one of the apertures in said roller means so as to prevent uncoiling of the coiled tress of hair from said roller means, the teeth of said comb means being of thin generally columnar configuration substantially the entire length thereof and of a dimension longitudinally of the elongated body portion of said comb means not greater than the lateral dimension of the teeth thereby to minimize separation and spreading of said tress longitudinally of said roller means upon penetration of the teeth of said comb means into said tress as said comb means moves to said second position within the aperture in said roller means.

* * * * *